US010995723B2

(12) United States Patent
Dolane et al.

(10) Patent No.: US 10,995,723 B2
(45) Date of Patent: May 4, 2021

(54) MAGNETO IGNITION SYSTEM AND IGNITION CONTROL SYSTEM

(71) Applicant: Walbro LLC, Tucson, AZ (US)

(72) Inventors: Justin T. Dolane, Cass City, MI (US); Bradley J. Roche, Millington, MI (US)

(73) Assignee: Walbro LLC, Tucson, AZ (US)

( * ) Notice: Subject to any disclaimer, the term of this patent is extended or adjusted under 35 U.S.C. 154(b) by 0 days.

(21) Appl. No.: 16/624,532

(22) PCT Filed: Jun. 21, 2018

(86) PCT No.: PCT/US2018/038673
§ 371 (c)(1),
(2) Date: Dec. 19, 2019

(87) PCT Pub. No.: WO2018/237104
PCT Pub. Date: Dec. 27, 2018

(65) Prior Publication Data

US 2020/0132035 A1 Apr. 30, 2020

Related U.S. Application Data

(60) Provisional application No. 62/522,957, filed on Jun. 21, 2017.

(51) Int. Cl.
*F02P 5/15* (2006.01)
*F02P 1/08* (2006.01)

(52) U.S. Cl.
CPC ..... *F02P 1/086* (2013.01); *F02P 5/1502* (2013.01)

(58) Field of Classification Search
CPC ..... F02P 1/086; F02P 5/1502
USPC ..... 123/596, 597, 600, 601, 605, 618, 623
See application file for complete search history.

(56) References Cited

U.S. PATENT DOCUMENTS

| | | | | |
|---|---|---|---|---|
| 6,549,843 | B1 | 4/2003 | Koerner | |
| 7,392,798 | B2 * | 7/2008 | Wada | F02P 15/08 123/620 |
| 7,448,358 | B2 | 11/2008 | Andersson et al. | |
| 7,546,836 | B2 | 6/2009 | Andersson et al. | |
| 9,793,757 | B2 * | 10/2017 | Moeskops | G01R 19/165 |
| 2005/0279326 | A1 | 12/2005 | Andersson et al. | |
| 2007/0073449 | A1 | 3/2007 | Kraemer et al. | |

(Continued)

FOREIGN PATENT DOCUMENTS

| | | | |
|---|---|---|---|
| EP | 1643121 | A2 | 4/2006 |
| WO | WO2017015420 | A1 | 1/2017 |
| WO | WO2017185017 | A1 | 10/2017 |

OTHER PUBLICATIONS

Written Opinion & International Search Report for PCT/US2018/038673 dated Oct. 25, 2018, 16 pages.

(Continued)

*Primary Examiner* — Hai H Huynh
(74) *Attorney, Agent, or Firm* — Reising Ethington P.C.

(57) ABSTRACT

In at least some implementations, an ignition system for a combustion engine includes a controller, an ignition circuit, and a wire providing two-way communication between the ignition circuit and the controller. The ignition circuit may include a charge capacitor that is discharged to cause an ignition event. The ignition circuit may be an inductive discharge ignition circuit including a coil and may then also include a second wire that provides electrical power to the coil.

20 Claims, 4 Drawing Sheets

(56) References Cited

U.S. PATENT DOCUMENTS

| | | | |
|---|---|---|---|
| 2007/0175461 | A1 | 8/2007 | Wada et al. |
| 2008/0178841 | A1 | 7/2008 | Andersson et al. |
| 2008/0262706 | A1 | 10/2008 | Olsson |
| 2016/0076506 | A1 | 3/2016 | Andersson et al. |
| 2017/0067435 | A1 | 3/2017 | Li et al. |

OTHER PUBLICATIONS

Swedish Office Action for SE Application No. 1951370-4 dated Mar. 12, 2020 (8 pages).

* cited by examiner

MAGNETO IGNITION SYSTEM AND IGNITION CONTROL SYSTEM

REFERENCE TO RELATED APPLICATIONS

This application claims the benefit of U.S. Provisional Application Ser. No. 62/522,957 filed on Jun. 21, 2017, the entire contents of which are incorporated herein by reference in their entireties.

TECHNICAL FIELD

The present disclosure relates generally to magneto ignition systems for combustion engines.

BACKGROUND

Capacitor discharge ignition (CDI) systems are widely used in spark-ignited internal combustion engines. Generally, CDI systems include a main capacitor, which during each cycle of an engine, is charged by an associated generator or charge coil and is later discharged through a step-up transformer or ignition coil to fire a spark plug. CDI systems typically have a stator assembly and one or more magnets are typically mounted on an engine flywheel to generate current pulses within the charge coil as the magnets are rotated past the stator. The current pulses produced in the charge coil are used to charge the main capacitor which is subsequently discharged upon activation of a trigger signal. The trigger signal is supplied by a trigger coil that is also wound around the stator core, wherein the permanent magnet assembly cycles past the stator core to generate pulses within the trigger coil. A microprocessor has inputs and outputs and is coupled to the ignition circuit by multiple wires which each separately provide signals to and from the microprocessor to control operation of the ignition system in accordance with various factors such as engine speed and desired ignition timing.

SUMMARY

In at least some implementations, an ignition system for a combustion engine includes a controller, an ignition circuit, and a wire providing two-way communication between the ignition circuit and the controller. The ignition circuit may include a charge capacitor that is discharged to cause an ignition event. The ignition circuit may be an inductive discharge ignition circuit including a coil and may then also include a second wire that provides electrical power to the coil.

One or more than one of the following may be communicated via the wire that provides two-way communication: a signal indicative of a temperature; a signal indicative of the position of an engine component and a signal to cause an ignition event. In at least some implementations, a signal indicative of the position of an engine component, such as a piston, is provided from the ignition circuit to the controller via the wire that provides two-way communication and a signal to cause an ignition event is provided from the controller to the ignition circuit via the wire that provides two-way communication. In at least some implementations, the voltage on the wire is pulled either up or down to a reference voltage when the engine component reaches a certain position during a revolution of the engine, and the voltage on the wire is pulled either up or down to a reference voltage by the controller to cause an ignition event. In at least some implementations, the voltage on the wire is pulled to ground when the engine component reaches a certain position during a revolution of the engine, and/or the voltage on the wire is pulled up to a reference voltage by the controller to send a signal to a controller that causes an ignition event.

In at least some implementations, a signal indicative of a temperature is also provided from the ignition circuit to the controller via the wire that provides two-way communication. An analog voltage on the wire may provide a signal or output indicative of a temperature.

In at least some implementations, an ignition system for a combustion engine having a movable engine component includes a controller, an ignition circuit, and a wire coupled to both the controller and the ignition circuit and providing two-way communication between the ignition circuit and the controller, the voltage on the wire is pulled one of up or down to a reference voltage when the engine component reaches a certain position, and wherein the voltage on the wire is pulled the other of up or down to a reference voltage by the controller to cause an ignition event.

In at least some implementations, the voltage on the wire is pulled to ground when the engine component reaches a certain position, and the voltage on the wire is pulled up to cause an ignition event. In at least some implementations, a signal indicative of a temperature is also provided from the ignition circuit to the controller via the wire. And a analog voltage on the wire may be indicative of a temperature.

BRIEF DESCRIPTION OF THE DRAWINGS

The following detailed description of certain embodiments and best mode will be set forth with reference to the accompanying drawings, in which.

DETAILED DESCRIPTION

The methods and systems described herein generally relate to combustion engines that including ignition systems with microcontroller circuitry, including but not limited to light-duty combustion engines. Typically, the light-duty combustion engine is a single cylinder two-stroke or four-stroke gasoline powered internal combustion engine. A piston is slidably received for reciprocation in an engine cylinder and is connected to a crank shaft that, in turn, is attached to a fly wheel. Such engines are often paired with a capacitive discharge ignition (CDI) system that utilizes a microcontroller to supply a high voltage ignition pulse to a spark plug for igniting an air-fuel mixture in the engine combustion chamber. The term "light-duty combustion engine" broadly includes all types of non-automotive combustion engines, including two and four-stroke engines typically used to power devices such as gasoline-powered hand-held power tools, lawn and garden equipment, lawnmowers, weed trimmers, edgers, chain saws, snowblowers, personal watercraft, boats, snowmobiles, motorcycles, all-terrain-vehicles, etc. It should be appreciated that while the following description is in the context of a capacitive discharge ignition (CDI) system, the control circuit and/or the power supply sub-circuit described herein may be used with any number of different ignition systems and are not limited to the particular one shown here. Further, while generally described with reference to a light-duty combustion engine, the methods and components described herein may be used with other types of engines including multi-cylinder engines, engines for automotive applications and other larger engines.

Figure 1:
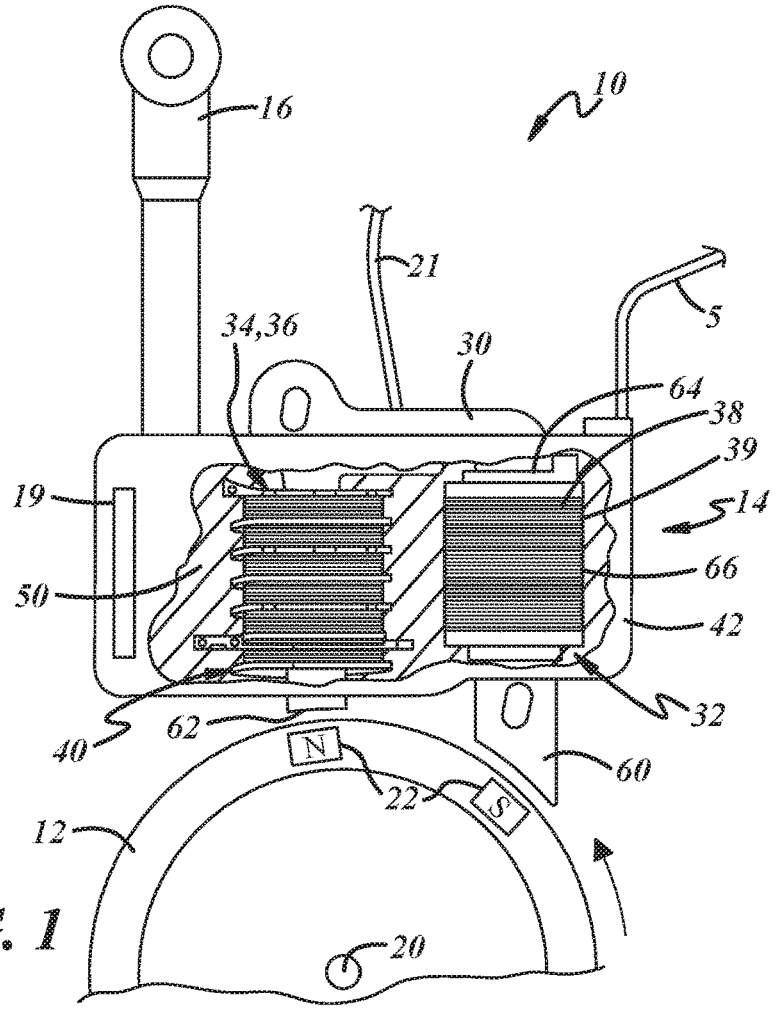
FIG. 1 shows an example of a capacitor discharge ignition (CDI) system for a light-duty combustion engine.

With reference to FIG. 1, there is shown a cut-away view of an exemplary capacitive discharge ignition (CDI) system 10 that interacts with a flywheel 12 and generally includes an ignition module 14, an ignition lead 16 for electrically coupling the ignition module to a spark plug SP (shown in FIG. 2), and electrical connections 5, 21 for coupling the ignition module to one or more auxiliary loads, such as a carburetor solenoid valve. The flywheel 12 shown here includes a pair of magnetic poles or elements 22 located towards an outer periphery of the flywheel. Once flywheel 12 is rotating, magnetic elements 22 spin past and electromagnetically interact with the different coils or windings in ignition module 14.

Ignition module 14 can generate, store, and utilize the electrical energy that is induced by the rotating magnetic elements 22 in order to perform a variety of functions. According to one embodiment, ignition module 14 includes a lamstack 30, a charge winding 32, a primary winding 34 and a secondary winding 36 that together constitute a step-up transformer, a first auxiliary winding 38, a second auxiliary winding 39, a trigger winding 40, an ignition module housing 42, and a control circuit 50. Lamstack 30 is preferably a ferromagnetic part that is comprised of a stack of flat, magnetically-permeable, laminate pieces typically made of steel or iron. The lamstack can assist in concentrating or focusing the changing magnetic flux created by the rotating magnetic elements 22 on the flywheel. According to the embodiment shown here, lamstack 30 has a generally U-shaped configuration that includes a pair of legs 60 and 62. Leg 60 is aligned along the central axis of charge winding 32, and leg 62 is aligned along the central axes of trigger winding 40 and the step-up transformer. The first auxiliary winding 38, second auxiliary winding 39 and trigger winding 40 are shown on leg 60, however, these windings or coils could be located elsewhere on the lamstack 30. Magnetic elements 22 can be implemented as part of the same magnet or as separate magnetic components coupled together to provide a single flux path through flywheel 12, to cite two of many possibilities. Additional magnetic elements can be added to flywheel 12 at other locations around its periphery to provide additional electromagnetic interaction with ignition module 14.

Charge winding 32 generates electrical energy that can be used by ignition module 14 for a number of different purposes, including charging an ignition capacitor and powering an electronic processing device, to cite two of many examples. Charge winding 32 includes a bobbin 64 and a winding 66 and, according to one embodiment, is designed to have a relatively low inductance and a relatively low resistance, but this is not necessary.

Trigger winding 40 provides ignition module 14 with an engine input signal that is generally representative of the position and/or speed of the engine. According to the particular embodiment shown here, trigger winding 40 is located towards the end of lamstack leg 62 and is adjacent to the step-up transformer. It could, however, be arranged at a different location on the lamstack. For example, it is possible to arrange both the trigger and charge windings on a single leg of the lamstack, as opposed to arrangement shown here. It is also possible for trigger winding 40 to be omitted and for ignition module 14 to receive an engine input signal from charge winding 32 or some other device.

Step-up transformer uses a pair of closely-coupled windings 34, 36 to create high voltage ignition pulses that are sent to a spark plug SP via ignition lead 16. Like the charge and trigger windings described above, the primary and secondary windings 34, 36 surround one of the legs of lamstack 30, in this case leg 62. The primary winding 34 has fewer turns of wire than the secondary winding 36, which has more turns of finer gauge wire. The turn ratio between the primary and secondary windings, as well as other characteristics of the transformer, affect the voltage and are typically selected based on the particular application in which it is used.

Ignition module housing 42 is preferably made from a plastic, metal, or some other material, and is designed to surround and protect the components of ignition module 14. The ignition module housing has several openings to allow lamstack legs 60 and 62, ignition lead 16, and electrical connections 5, 21 to protrude, and preferably are sealed so that moisture and other contaminants are prevented from damaging the ignition module. It should be appreciated that ignition system 10 is just one example of a capacitive discharge ignition (CDI) system that can utilize ignition module 14, and that numerous other ignition systems and components, in addition to those shown here, could also be used as well.

Control circuit 50 may be carried within the housing 42 or within a housing remote from the flywheel and lamstack and communicated with the ignition module 14 to receive energy from the module 14 and to control, at least in part, operation of the module. For example, a control module may be located on or adjacent to a throttle body, such as is shown and described in PCT Patent Application Serial No. U.S. Ser. No. 17/028,913 filed Apr. 21, 2017 the disclosure of which is incorporated herein by reference in its entirety. Such a module may be responsive to a throttle valve position and/or other variables to control ignition timing, a fuel/air mixture content (such as by varying the amount of fuel or air with a valve), whether to cause an ignition event in a given engine cycle, engine speed control, among other things. The module could be located remotely from the engine and any throttle body, carburetor or other component associated with the engine, for example, in a handle, housing, cowling or other component of a vehicle or device that includes the engine. The control module may be coupled to portions of the ignition module 14 so that it can control, if desired, the energy that is induced, stored and discharged by the ignition system 10. The term "coupled" broadly encompasses all ways in which two or more electrical components, devices, circuits, etc. can be in electrical communication with one another; this includes but is certainly not limited to, a direct electrical connection and a connection via intermediate components, devices, circuits, etc. The control circuit 50 may be provided according to the exemplary embodiment shown in FIG. 2 where the control circuit is coupled to and interacts with charge winding 32, primary ignition winding 34, first auxiliary winding 38, second auxiliary winding 39, and trigger winding 40. According to this particular example, the control circuit 50 includes an ignition discharge capacitor 52, an ignition discharge switch 54, a microcontroller 56, a power supply sub-circuit 58, as well as any number of other electrical elements, components, devices and/or sub-circuits that may be used with the control circuit and are known in the art (e.g., kill switches and kill switch circuitry).

The ignition discharge capacitor 52 acts as a main energy storage device for the ignition system 10. According to the embodiment shown in FIG. 2, the ignition discharge capacitor 52 is coupled to the charge winding 32 and the ignition discharge switch 54 at a first terminal, and is coupled to the primary winding 34 at a second terminal. The ignition discharge capacitor 52 is configured to receive and store electrical energy from the charge winding 32 via diode 70 and to discharge the stored electrical energy through a path that includes the ignition discharge switch 54 and the primary winding 34. Discharge of the electrical energy stored on the ignition discharge capacitor 52 is controlled by the state of the ignition discharge switch 54, as is widely understood in the art. As these components are coupled to one or more coils in the ignition module 14, these components may, if desired, be located within the ignition module on a circuit board 19 or otherwise arranged.

The ignition discharge switch 54 acts as a main switching device for the ignition system 10. The ignition discharge switch 54 is coupled to the ignition discharge capacitor 52 at a first current carrying terminal, to ground at a second current carrying terminal, and to an output of the microcontroller 56 at its gate. As noted herein, the microcontroller 56 may be located remotely, if desired, which is to say not within the ignition module 14. The ignition discharge switch 54 can be provided as a thyristor, for example, a silicon controller rectifier (SCR). An ignition trigger signal from an output of the microcontroller 56 activates the ignition discharge switch 54 so that the ignition discharge capacitor 52 can discharge its stored energy through the switch and thereby create a corresponding ignition pulse in the ignition coil.

The microcontroller 56 is an electronic processing device that executes electronic instructions in order to carry out functions pertaining to the operation of the light-duty combustion engine. This may include, for example, electronic instructions used to implement the methods described herein. In one example, the microcontroller 56 includes the 8-pin processor illustrated in FIG. 2, however, any other suitable controller, microcontroller, microprocessor and/or other electronic processing device may be used instead. Pins 1 and 8 are coupled to the power supply sub-circuit 58, which provides the microcontroller with power that is somewhat regulated; pins 2 and 7 are coupled to trigger winding 40 and provide the microcontroller with an engine signal that is representative of the speed and/or position of the engine (e.g., position relative to top-dead-center); pins 3 and 5 are shown as being unconnected, but may be coupled to other components like a kill-switch used to stop engine operation; pin 4 is coupled to ground; and pin 6 is coupled to the gate of ignition discharge switch 54 so that the microcontroller can provide an ignition trigger signal, sometimes called a timing signal, for activating the switch. Some non-limiting examples of how microcontrollers can be implemented with ignition systems are provided in U.S. Pat. Nos. 7,546,836 and 7,448,358, the entire contents of which are hereby incorporated by reference.

The power supply sub-circuit 58 receives electrical energy from the charge winding 32, stores the electrical energy, and provides the microcontroller 56 with regulated, or at least somewhat regulated, electrical power. The power supply sub-circuit 58 is coupled to the charge winding 32 at an input terminal 80 and to the microcontroller 56 at an output terminal 82 and, according to the example shown in FIG. 2, includes a first power supply switch 90, a power supply capacitor 92, a power supply zener 94, a second power supply switch 96, and one or more power supply resistors 98. As will be explained below in more detail, the power supply sub-circuit 58 is designed and configured to reduce the portion of the charge winding load that is attributable to powering the microcontroller 56, or other electrically powered devices, like a solenoid or the like. The components of the power supply sub-circuit 58 may be located in the ignition module, the control module that is separate from the ignition module, or a combination of the two, as desired.

The first power supply switch 90, which can be any suitable type of switching device like a BJT or MOSFET, is coupled to the charge winding 32 at a first current carrying terminal, to the power supply capacitor 92 at a second current carrying terminal, and to the second power supply switch 96 at a base or gate terminal. When the first power supply switch 90 is activated or is in an 'on' state, current is allowed to flow from the charge winding 32 to the power supply capacitor 92; when the switch 90 is deactivated or is in an 'off' state, current is prevented from flowing from the charge winding 32 to the capacitor 92. As mentioned above, any suitable type of switching device may be used for the first power supply switch 90, but such a device should be able to handle a significant amount of voltage; for example between about 150 V and 450 V.

The power supply capacitor 92 is coupled to the first power supply switch 90, the power supply zener 94 and the microcontroller 56 at a positive terminal, and is coupled to ground at a negative terminal. The power supply capacitor 92 receives and stores electrical energy from the charge winding 32 so that it may power the microcontroller 56 in a somewhat regulated and consistent manner.

The power supply zener 94 is coupled to the power supply capacitor 92 at a cathode terminal and is coupled to second power supply switch 96 at an anode terminal. The power supply zener 94 is arranged to be non-conductive so as long as the voltage on the power supply capacitor 92 is less than the breakdown voltage of the zener diode and to be conductive when the capacitor voltage exceeds the breakdown voltage. A zener diode with a particular breakdown voltage may be selected based on the amount of electrical energy that is deemed necessary for the power supply sub-circuit 58 to properly power the microcontroller 56. Any zener diode or other similar device may be used, including zener diodes having a breakdown voltage between about 3V and 20V.

The second power supply switch 96 is coupled to resistor 98 and the base of the first power supply switch 90 at a first current carrying terminal, to ground at a second current carrying terminal, and to the power supply zener diode 94 at a gate. As will be described below in more detail, the second power supply switch 96 is arranged so that when the voltage at the zener diode 94 is less than its breakdown voltage, the second power supply switch 96 is held in a deactivated or 'off' state; when the voltage at the zener diode exceeds the breakdown voltage, then the voltage at the gate of the second power supply switch 96 increases and activates that device so that it turns 'on'. Again, any number of different types of switching devices may be used, including thyristors in the form of silicon controller rectifiers (SCRs). According to one non-limiting example, the second power supply switch is an SCR and has a gate current rate between about 2 □A and 3 mA.

The power supply resistor 98 is coupled at one terminal to charge winding 32 and one of the current carrying terminals of the first power supply switch 90, and at another terminal to one of the current carrying terminals of the second power supply switch 96. It is preferable that power supply resistor 98 have a sufficiently high resistance so that a high-resistance, low-current path is established through the resistor when the second power supply switch 96 is turned 'on'. In one example, the power supply resistor 98 has a resistance between about 5 kΩ and 10 kΩ, however, other values may certainly be used instead.

Figure 2:
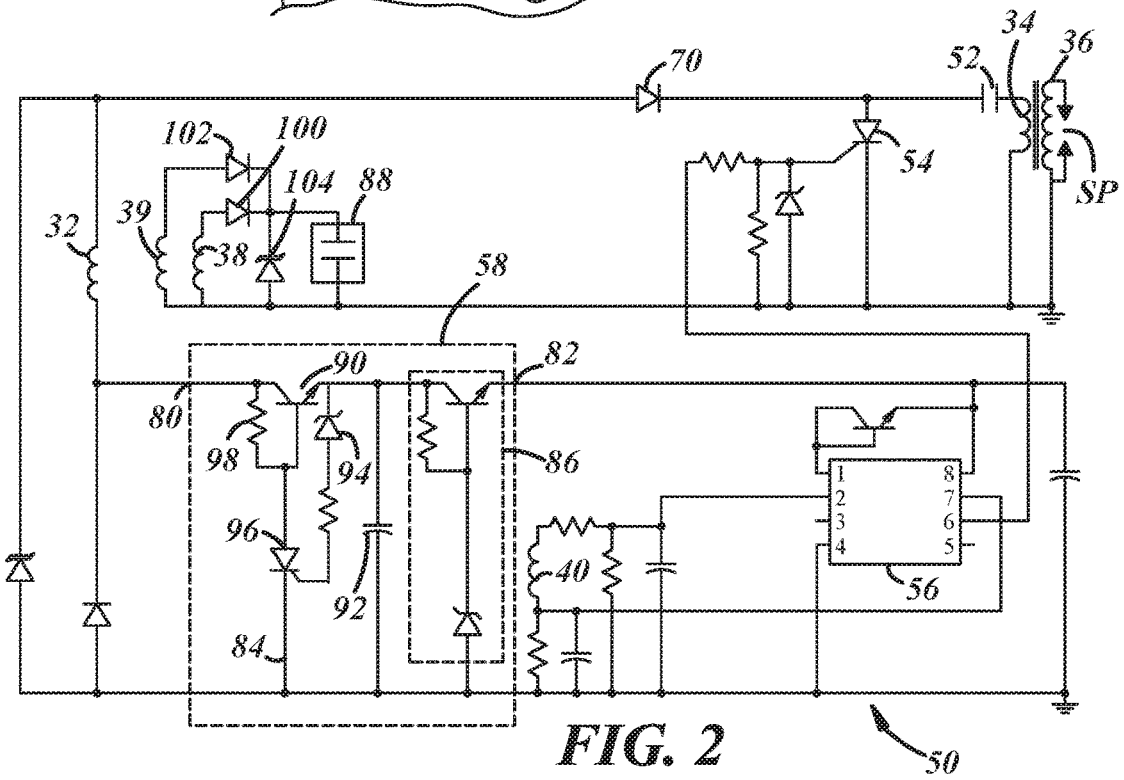
FIG. 2 is a schematic diagram of a circuit that may be used with the CDI system of FIG. 1.

During a charging cycle, electrical energy induced in the charge winding 32 may be used to charge, drive and/or otherwise power one or more devices around the engine. For example, as the flywheel 12 rotates past the ignition module 14, the magnetic elements 22 carried by the flywheel induce an AC voltage in the charge winding 32. A positive component of the AC voltage may be used to charge the ignition discharge capacitor 52, while a negative component of the AC voltage may be provided to the power supply sub-circuit 58 which then powers the microcontroller 56 with regulated DC power. The power supply sub-circuit 58 may be designed to limit or reduce the amount of electrical energy taken from the negative component of the AC voltage to a level that is still able to sufficiently power the microcontroller 56, yet saves energy for use elsewhere in the system, for example to drive a fuel injector in an electronic fuel injection system, as diagrammatically shown in FIG. 5 where power generated in the ignition circuit at 140 is provided to an EFI system via wire 142. Another example of a device that may benefit from this energy savings is a solenoid that is coupled to the windings 38 and 39 and is used to control the air/fuel ratio being provided to the combustion chamber. The power supply sub-circuit may be constructed and arranged as shown in FIG. 2 and as described in PCT Application Publication WO 2017/015420.

Beginning with the positive portion of the AC voltage that is induced in the charge winding 32, current flows through diode 70 and charges ignition discharge capacitor 52. So long as the microcontroller 56 holds the ignition discharge switch 54 in an 'off' state, the current from the charge winding 32 is directed to the ignition discharge capacitor 52. It is possible for the ignition discharge capacitor 52 to be charged throughout the entire positive portion of the AC voltage waveform, or at least for most of it. When it is time for the ignition system 10 to fire the spark plug SP (i.e., the ignition timing), the microcontroller 56 sends an ignition trigger signal to the ignition discharge switch 54 that turns the switch 'on' and creates a current path that includes the ignition discharge capacitor 52 and the primary ignition winding 34. The electrical energy stored on the ignition discharge capacitor 52 rapidly discharges via the current path, which causes a surge in current through the primary ignition winding 34 and creates a fast-rising electro-magnetic field in the ignition coil. The fast-rising electromagnetic field induces a high voltage ignition pulse in the secondary ignition winding 36 that travels to the spark plug SP and provides a combustion-initiating spark. Other sparking techniques, including flyback techniques, may be used instead.

Turning now to the negative component or portion of the AC voltage that is induced in the charge winding 32, current initially flows through the first power supply switch 90 and charges power supply capacitor 92. So long as second power supply switch 96 is turned 'off', there is current flow through power supply resistor 98 so that the voltage at the base of the first power supply switch 90 biases the switch in an 'on' state. Charging of the power supply capacitor 92 continues until a certain charge threshold is met; that is, until the accumulated charge on capacitor 92 exceeds the breakdown voltage of the power supply zener 94. As mentioned above, zener diode 94 is preferably selected to have a certain breakdown voltage that corresponds to a desired charge level for the power supply sub-circuit 58. Some initial testing has indicated that a breakdown voltage of approximately 6 V may be suitable in some light-duty engine applications, although other values may be used. The power supply capacitor 92 uses the accumulated charge to provide the microcontroller 56 with regulated DC power. Of course, additional circuitry like the secondary stage circuitry 86 may be employed for reducing ripples and/or further filtering, smoothing and/or otherwise regulating the DC power.

Once the stored charge on the power supply capacitor 92 exceeds the breakdown voltage of the power supply zener 94, the zener diode becomes conductive in the reverse bias direction so that the voltage seen at the gate of the second power supply switch 96 increases. This turns the second power supply switch 96 'on', which creates a low current path 84 that flows through resistor 98 and switch 96 and lowers the voltage at the base of the first power supply switch 90 to a point where it turns that switch 'off'. With first power supply switch 90 deactivated or in an 'off' state, additional charging of the power supply capacitor 92 is prevented. Moreover, power supply resistor 98 preferably exhibits a relatively high resistance so that the amount of current that flows through the low current path 84 during this period of the negative portion of the AC cycle is minimal (e.g., on the order of 50 μA) and, thus, limits the amount of wasted electrical energy. The first power supply switch 90 will remain 'off' until the microcontroller 56 pulls enough electrical energy from power supply capacitor 92 to drop its voltage below the breakdown voltage of the power supply zener 94, at which time the second power supply switch 96 turns 'off' so that the cycle can repeat itself. This arrangement may somewhat simulate a low cost hysteresis approach.

Accordingly, instead of charging the power supply capacitor 92 during the entire negative portion of the AC voltage waveform, the power supply sub-circuit 58 only charges capacitor 92 for a first segment of the negative portion of the AC voltage waveform; during a second segment, the capacitor 92 is not being charged. Put differently, the power supply sub-circuit 58 only charges the power supply capacitor 92 until a certain charge threshold is reached, after which additional charging of capacitor 92 is cut off. Because less electrical current is flowing from the charge winding 32 to the power supply sub-circuit 58, the electromagnetic load on the winding and/or the circuit is reduced, thereby making more electrical energy available for other windings and/or other devices. If the electrical energy in the ignition system 10 is managed efficiently, it may possible for the system to support both an ignition load and external loads (e.g., an air/fuel ratio regulating solenoid) on the same magnetic circuit.

This arrangement and approach is different than simply utilizing a simple current limiting circuit to clip the amount of current that is allowed into the power supply sub-circuit 58 at any given time. Such an approach may result in undesirable effects, in that it may be slow to reach a working voltage due to the limited current available, thus, causing unwanted delays in the functionality of the ignition system. The power supply sub-circuit 58 is designed to allow higher amounts of current to quickly flow into the power supply capacitor 92, which charges the power supply more rapidly and brings it to a sufficient DC operating level in a shorter amount of time than is experienced with a simple current limiting circuit.

As mentioned above, the electrical energy that is saved or not used by power supply sub-circuit 58 may be applied to any number of different devices around the engine. One example of such a device is a solenoid that controls the air/fuel ratio of the gas mixture supplied from a carburetor to a combustion chamber. Referring back to FIG. 2, the first auxiliary winding 38 and the second auxiliary winding 39 could be coupled to a device 88, such as a solenoid, an additional microcontroller or any other device requiring electrical energy. The first and second auxiliary windings 38 and 39 may be connected in parallel with each other and may each have one terminal coupled to the solenoid via intervening diodes 100 and 102, respectively and their other terminals coupled to ground. A zener diode 104 may be connected in parallel between the solenoid and coils 38 and 39 to protect the solenoid from a voltage greater than the zener diode breakdown voltage (excess current flows through the zener diode to ground).

Because the magnets 22 are fixed to the flywheel 12, the position of the magnets relative to one or more coils of the ignition circuit may be used to determine the position of the flywheel and thus, the position of the crankshaft and piston. This information may also be used to determine the engine speed (e.g. the time from a certain engine position in one revolution to the same engine position in the next revolution may be used to determine the engine speed during that revolution). Use of multiple magnets spaced about the periphery of the flywheel can enhance the resolution of this determination by providing more data points in a revolution. Engine speed may also be determined by a sensor that is responsive to the position of the flywheel. Representative sensors including magnetically responsive sensors like hall-effect sensors or variable reluctance sensors. The flywheel may have teeth and the sensors may be responsive to the passing by of one or more teeth to determine flywheel position and hence, crankshaft position. The trigger coil 40 or a different coil in the ignition module may be used as a VR sensor as noted above.

Further, the engine temperature, or an approximation thereof, may be determined as a function of certain parameters of ignition circuit components that change as a function of temperature. In other words, by measuring a temperature dependent parameter of one or more components, the temperature of that component can be determined and the engine temperature, or an approximation thereof, can be determined as a function of the component temperature.

Advantageously, components already in the ignition circuit may have temperature dependent parameters so that the temperature can be determined without adding a sensor or additional circuit component to the system. For example, the threshold voltage of a diode may change as a function of the temperature of the diode. For a given diode, the threshold voltage at a given time can be correlated to the temperature of the diode. Accordingly, to determine the temperature of the diode, the threshold voltage may be measured or determined. Similarly, the base-to-emitter voltage of a BJT transistor and/or a saturation current of a BJT transistor change as a function of the temperature of the transistor. Thus, these characteristics can be measured or determined to determine the temperature of the transistor.

Other components having a temperature dependent parameter may also be used. By way or one non-limiting example, the resistance of a conductor changes as a function of the temperature of the conductor. In general, metal conductors have higher resistance at higher temperatures and non-metallic conductors like carbon, silicon, and germanium have lower resistance at higher temperatures. Hence, the resistance of a conductor already in the circuit or added to the circuit can be determined to determine the temperature of the conductor.

Engine temperature or an approximation thereof may be used in any number of ways, such as to control ignition timing, air/fuel ratio, engine speed and the like. In some applications, the ignition timing and air/fuel ratio may be at certain settings upon initially starting a cold engine and during initial warm-up of the engine. Those settings may change when the engine is suitably warm and operating with more stability. Further, the engine speed may be limited during initial engine operation to avoid engaging a clutch (e.g. a clutch for a chainsaw chain) during starting of the engine. Engine speed may be increased compared to normal idle speed during initial engine operation (e.g. a fast-idle mode) to facilitate warming-up a cold engine. Any one or all of these options may be better controlled with an indication of engine temperature as set forth herein.

With a remotely located microcontroller 56, the ignition module can be greatly simplified and a single controller may be used to control systems in a given application in addition to the ignition system. For example, electrically actuated valves like a throttle valve actuating motor, a solenoid valve and/or a fuel injector may be controlled by the same microcontroller that controls ignition timing and the ignition circuit more generally. Further simplification can be achieved by providing two-way communication between the ignition module and the remotely located microcontroller over a single wire 5.

Figure 3:
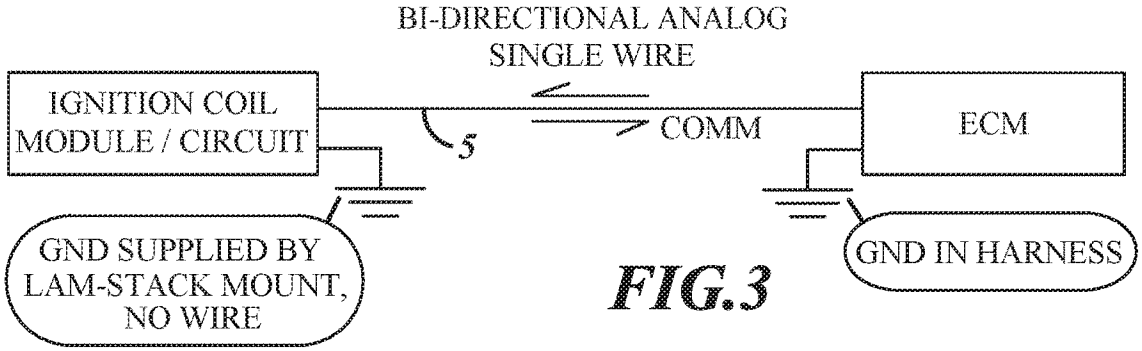
FIG. 3 is a diagrammatic view of an ignition coil circuit and electronic control module (ECM) with a single wire between them.
Figure 4:
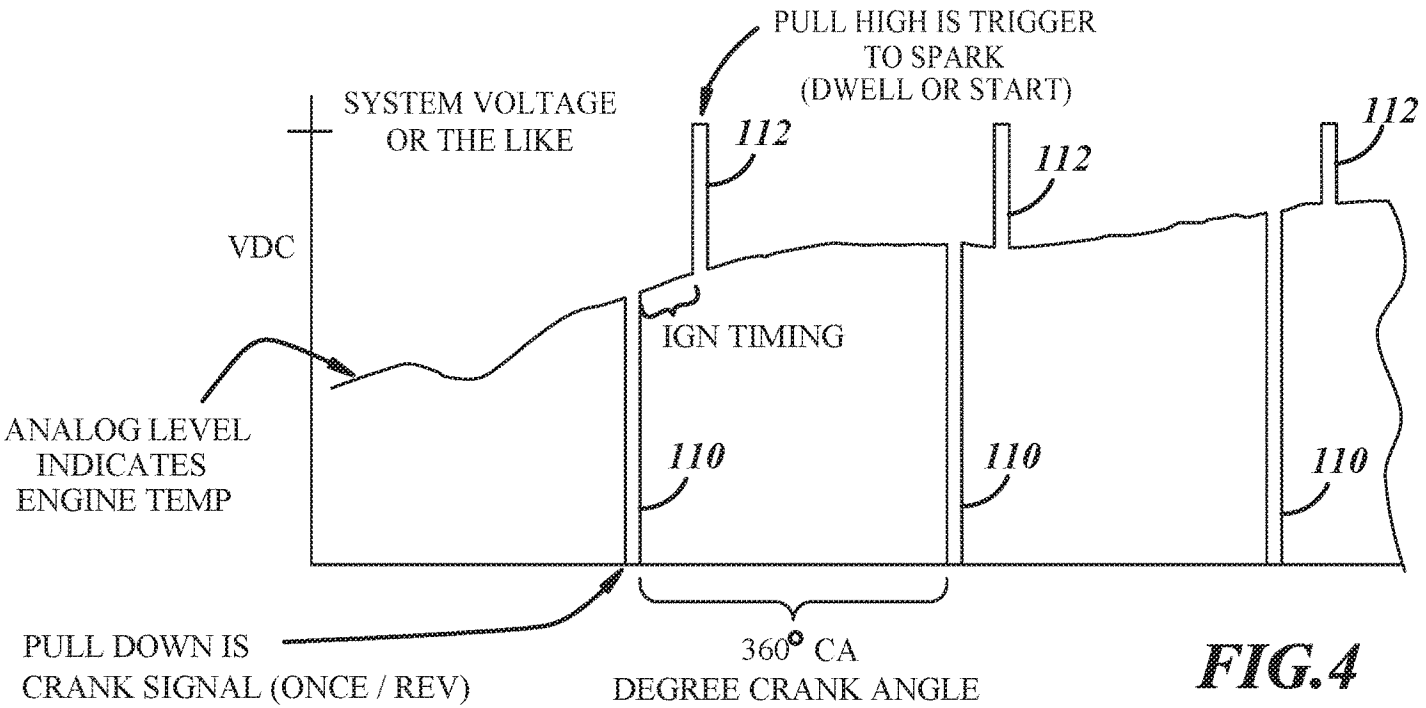
FIG. 4 is a graph showing voltage on the single wire as a function of engine position.
Figure 5:
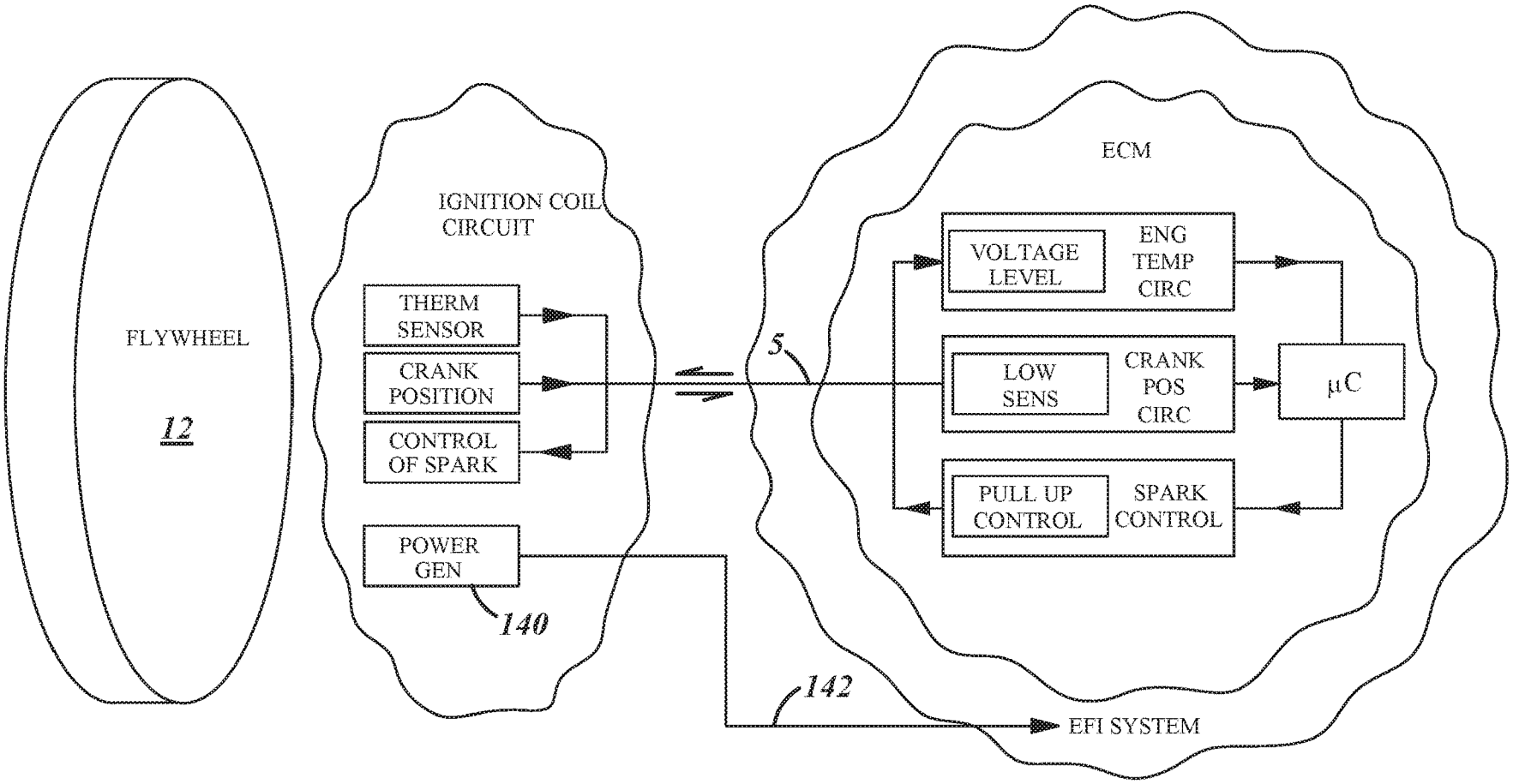
FIG. 5 is a diagrammatic view of an ignition coil circuit and electronic control module illustrating two-way communication between them over the single wire.

In at least some implementations such as is shown in FIGS. 3-5, the information that may be passed on a single wire includes temperature information, crankshaft position/crank angle, and instructions to cause an ignition event. Temperature information may be relayed to the microcontroller from the ignition coil circuit (the ignition circuit including the ignition coil) via the single wire as a function of an analog voltage signal on the wire. The crank angle or engine position at a given time can be determined by pulling the voltage on the single wire to ground, which may, for example, be done once per engine revolution as shown at 110 in FIG. 4. Similarly, pulling the voltage on the wire up, or increasing the voltage on the wire (e.g. to a level greater than the analog voltage), as shown at 112 in FIG. 4, may provide a signal to cause an ignition event. This may be done, for example, by communicating the wire with the ignition switch 54 and wherein the resultant pulled up voltage causes the switch to change state (e.g. from open to closed). As shown in FIG. 5, the temperature and crank angle information may be communicated over the wire from the ignition coil circuit to the controller and the ignition event signal can be provided over the wire, in the opposite direction. Likewise, the inverse can be true in that the crank angle or engine position can be determined by pulling the voltage on the wire up and the signal to cause an ignition event can be accomplished by pulling the voltage on the wire to ground. This may simplify and reduce the cost of the system, because in at least certain implementations because coil crank position processing subcircuit 124 can be replaced with a simple diode arranged to eliminate the negative portion of the VR generated signal.

Figure 6:
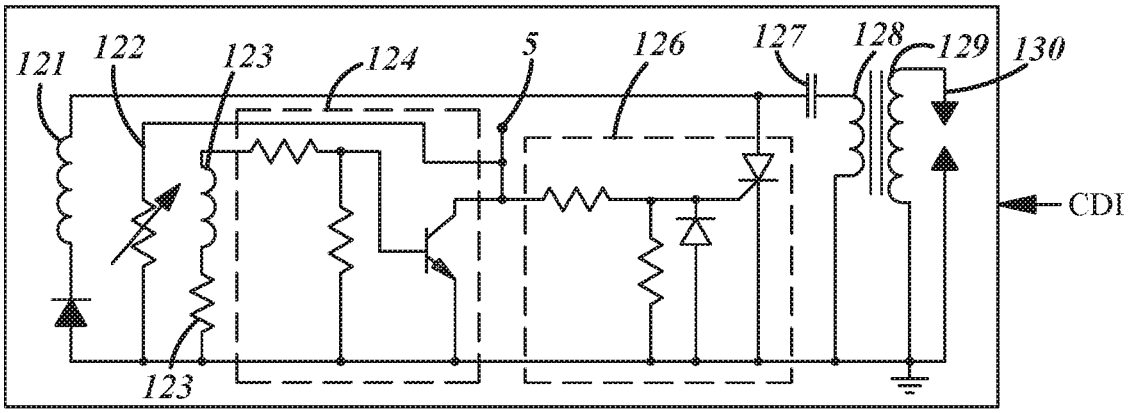
FIG. 6 is a schematic of a portion of an ignition circuit for a CDI system.
Figure 7:
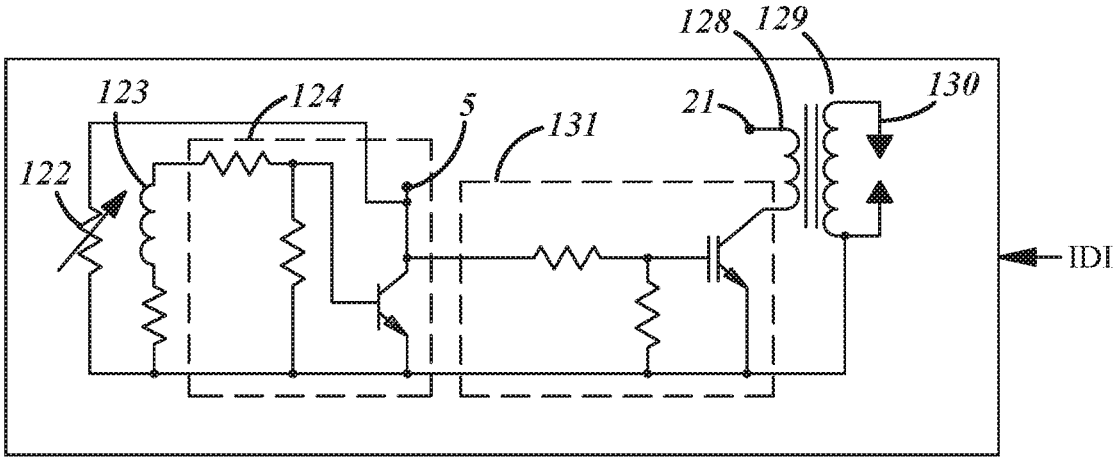
FIG. 7 is a schematic of a portion of an ignition circuit for an inductive discharge ignition (IDI) system.
Figure 8:
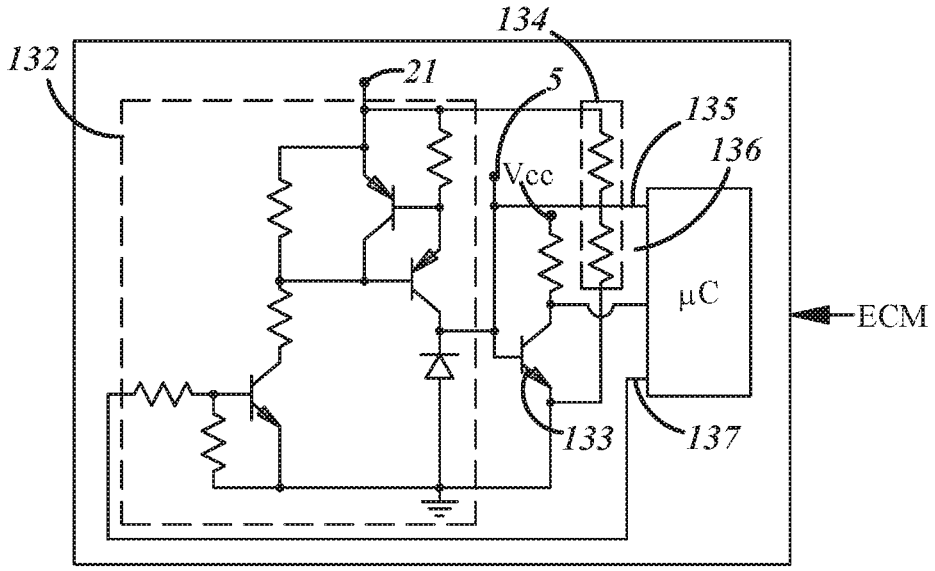
FIG. 8 is a schematic of a portion of a circuit of the ECM.

FIGS. 6-8 illustrate certain implementations of part of an ignition coil circuit that may be used with a capacitive discharge ignition system (CDI— FIG. 6), part of an ignition coil circuit that may be used with an inductive discharge ignition system (IDI—FIG. 7) and part of a control circuit or electronic control module (ECM) including the microcontroller (FIG. 8). As noted above, one or more magnets on the flywheel are moved passed the lamstack during engine operation and the charge coil 121 charges the charge capacitor 127 in a CDI system. The ECM ignition trigger output 137 drives ECM trigger circuit 132, which drives single wire connection 5 high to the level of battery voltage supply (VBATT) 21 when the microcontroller determines the necessary time to drive ignition (e.g. cause an ignition event). The ignition trigger output 137 could also be a low/ground asserted signal (e.g. voltage pulled low rather than pulled high) which, may enable the coil crank position processing subcircuit 124 to be simplified and cost reduced as noted above. In a CDI system, this event drives CDI drive circuit 126 to cause an ignition event. In an IDI system, this event drives IDI drive circuit 131 to allow current in primary coil 128 (begins the dwell). Ending this event (end of the dwell) causes breakdown at secondary coil 129 and spark plug 130 and an ignition event in known manner. In an IDI system, a second wire may provide a voltage (e.g. from a battery) to the coil 128.

The magnet(s) passing the lamstack also induce(s) a voltage in crank position coil 123 causes coil crank position processing subcircuit 124 to pull the single wire connection 5 to ground, sourced through grounding of the lamstack to engine (i.e, without requiring a separate ground wire) which causes ECM crank position circuit 133 to supply a signal to ECM crank position input 136 so the microcontroller can determine or know the angular displacement or position of the flywheel (and therefore, the crankshaft, etc.) during an engine revolution, enabling the microcontroller to determine and provide timing-specific outputs. If, as noted above, coil crank position processing subcircuit 124 were replaced with a diode arranged to eliminate the negative portion of the VR generated voltage, the crank position signal would be a positive voltage and the ignition trigger output 137 would be a ground-asserted signal.

A change in resistance of NTC temp sensor 122 causes a change in the voltage of the single wire connection 5 when the ECM trigger circuit 132 is floating (i.e. not pulled up or down, e.g. as an analog voltage) and when ECM crank position circuit 133 is floating. This causes ECM coil temp circuit 134 to change in potential, which supplies ECM engine temp ADC input 135 an analog voltage that is related to the temperature of the coil. This may be replaced by a silicon bandgap temperature sensor that measures the forward voltage of a diode or BJT, amplifies the signal, and supplies that to a circuit in the ECM, which would process the signal to supply the desired information to the ECM engine temp ADC input 135.

An example equation to relate voltage and temperature is shown and described below:

$$V_{BE} = V_{G0}\left(1 - \frac{T}{T_0}\right) + V_{BE0}\left(\frac{T}{T_0}\right)\left(\frac{nKT}{q}\right)\ln\left(\frac{T_0}{T}\right) + \left(\frac{KT}{q}\right)\ln\left(\frac{I_C}{I_{C0}}\right)$$

where

T=temperature in Kelvin, $T_0$=reference temperature, $V_{G0}$=bandgap voltage at absolute zero, $V_{BE0}$=junction voltage at temperature $T_0$ and current $I_{C0}$.

K=Boltzmann's constant, q=charge on an electron n=a device-dependent constant,

By comparing the voltages of two junctions at the same temperature, but at two different currents, $I_{C1}$ and $I_{C2}$, many of the variance in the above equation can be eliminated, resulting in the relationship:

$$\Delta V_{BE} = \frac{KT}{q} \cdot \ln\left(\frac{I_{c1}}{I_{c2}}\right)$$

Note that the junction voltage is a function of current density, i.e. current/junction area, and a similar output voltage can be obtained by operating the two junctions at the same current, if one is of a different area to the other.

A circuit that forces $I_{C1}$ and $I_{C2}$ to have a fixed N: 1 ratio, gives the relationship:

$$\Delta V_{BE} = \frac{KT}{q} \cdot \ln(N).$$

In at least some implementations, an ignition system for a combustion engine, includes a controller, an ignition circuit, and a wire providing two-way communication between the ignition circuit and the controller. The ignition circuit may be for a CDI system that includes a charge capacitor that is discharged to cause an ignition event. The ignition circuit may be for an inductive discharge ignition circuit including a coil and system may include a second wire that provides a voltage (e.g. from a battery) to the coil.

In at least some implementations, one or more than one of the following is communicated via the wire that provides two-way communication: a signal indicative of a temperature; a signal indicative of the position of an engine component and a signal to cause an ignition event. In at least some implementations, a signal indicative of the position of an engine component is provided from the ignition circuit to the controller via the wire that provides two-way communication and a signal to cause an ignition event is provided from the controller to the ignition circuit via the wire that provides two-way communication. A signal indicative of a temperature may also be provided from the ignition circuit to the controller via the wire that provides two-way communication.

In at least some implementations, the ignition coil may be used to provide the temperature signal, the signal indicative of the position of an engine component and the signal to cause an ignition event. These signals may be provided over one, two or three wires. In an arrangement with three wires, each signal may be provided over a separate one of the three wires such that each wire is used to transmit one of the signals. In an arrangement with two wires, one wire may be used to provide two of the three signals and the other wire may be used for the third of the three signals.

The forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. An ignition system for a combustion engine, comprising:

a controller;

an ignition circuit; and a wire providing two-way communication between the ignition circuit and the controller.

2. The ignition system of claim 1 wherein the ignition circuit includes a charge capacitor that is discharged to cause an ignition event.

3. The ignition system of claim 1 wherein the ignition circuit is an inductive discharge ignition circuit including a coil and which includes a second wire that provides electrical power to the coil.

4. The ignition system of claim 1 wherein one or more than one of the following is communicated via the wire that provides two-way communication: a signal indicative of a temperature; a signal indicative of the position of an engine component and a signal to cause an ignition event.

5. The ignition system of claim 4 wherein an analog voltage on the wire that provides two-way communication is indicative of a temperature.

6. The ignition system of claim 4 wherein the voltage on the wire is pulled either up or down to a reference voltage when the engine component reaches a certain position during a revolution of the engine.

7. The ignition system of claim 6 wherein the voltage on the wire is pulled to ground when the engine component reaches a certain position during a revolution of the engine.

8. The ignition system of claim 6 wherein the voltage on the wire is pulled up to a reference voltage by the controller to send a signal to a controller that causes an ignition event.

9. The ignition system of claim 4 wherein the voltage on the wire is pulled either up or down to a reference voltage by the controller to cause an ignition event.

10. The ignition system of claim 1 wherein a signal indicative of the position of an engine component is provided from the ignition circuit to the controller via the wire that provides two-way communication and a signal to cause an ignition event is provided from the controller to the ignition circuit via the wire that provides two-way communication.

11. The ignition system of claim 10 wherein a signal indicative of a temperature is also provided from the ignition circuit to the controller via the wire that provides two-way communication.

12. An ignition system for a combustion engine having a movable engine component, comprising:

a controller;

an ignition circuit; and a wire coupled to both the controller and the ignition circuit and providing at least two of a signal indicative of a position of an engine component, a signal indicative of engine temperature, and a signal to cause an ignition event.

13. The system of claim 12 wherein the voltage on the wire is pulled one of up or down to a reference voltage when the engine component reaches a certain position, and wherein the voltage on the wire is pulled the other of up or down to a reference voltage by the controller to cause an ignition event.

14. The system of claim 13 wherein the voltage on the wire is pulled to ground when the engine component reaches a certain position, and the voltage on the wire is pulled up to cause an ignition event.

15. The system of claim 12 wherein a signal indicative of a temperature is also provided from the ignition circuit to the controller via the wire.

16. The ignition system of claim 15 wherein an analog voltage on the wire is indicative of a temperature.

17. An ignition system for a combustion engine having a movable engine component, comprising:

a controller;

an ignition circuit including an ignition coil; and multiple wires coupled to both the controller and the ignition coil, wherein the wires transmit to or from the ignition coil a signal indicative of engine temperature as a function of ignition coil temperature, a signal indicative of the position of an engine component, and a signal to cause an ignition event.

18. The system of claim 17 wherein three wires are provided and each wire is used to provide a separate one of the three signals.

19. The system of claim 17 wherein two wires are provided and one wire is used to provide two of the three signals and the other wire is used to provide the third or the three signals.

20. The system of claim 17 wherein the voltage on one of the multiple wires is pulled one of up or down to a reference voltage when the engine component reaches a certain position, and wherein the voltage on one of the multiple wires is pulled the other of up or down to a reference voltage by the controller to cause an ignition event.

* * * * *